US005423118A

United States Patent [19]

Lotti

[11] Patent Number: 5,423,118

[45] Date of Patent: Jun. 13, 1995

[54] APPARATUS FOR APPLYING ANGLE BARS TO PALLETS

[75] Inventor: Nevio Lotti, Cesena, Italy

[73] Assignees: SORMA S.r.l., Rimini; Meccanica Sestese S.p.A., Paruzzaro, both of Italy

[21] Appl. No.: 215,934

[22] Filed: Mar. 22, 1994

[30] Foreign Application Priority Data

May 5, 1993 [IT] Italy ..... BO93A0188

[51] Int. Cl.[6] ..... B23Q 7/10

[52] U.S. Cl. ..... 29/809; 53/139.7

[58] Field of Search ..... 414/225, 752, 744.3, 414/744.5, 744.6, 744.7, 744.8; 29/772, 809, 238; 53/139.7; 221/211

[56] References Cited

U.S. PATENT DOCUMENTS

| | | | |
|---|---|---|---|
| 3,241,287 | 3/1966 | Chundelak, Jr. | 53/139.7 |
| 3,378,987 | 4/1968 | Lems | 53/139.7 |
| 3,585,780 | 6/1971 | Elmore | 53/139.7 |
| 4,897,980 | 2/1990 | Geyser et al. | 53/139.7 |
| 5,226,280 | 7/1993 | Scherer et al. | 29/809 |
| 5,289,668 | 3/1994 | Meyer | 53/139.7 |

*Primary Examiner*—Mark Rosenbaum
*Assistant Examiner*—David P. Bryant
*Attorney, Agent, or Firm*—Dvorak and Traub

[57] ABSTRACT

An apparatus for applying angle members to a pallet supporting a stack of containers, said apparatus working in conjunction with a known type strapping machine having a fixed vertical support and a mobile horizontal support, and comprising magazines, constrained to the vertical support, for holding angle members, and an angle member moving device, constrained to the mobile horizontal support, for withdrawing the angle members from the magazines and positioning the angle member on the pallet corners.

10 Claims, 4 Drawing Sheets

APPARATUS FOR APPLYING ANGLE BARS TO PALLETS

BACKGROUND OF THE INVENTION

The long operative chain leading to a final stacking and despatch of vegetable and fruit produce ends with the stacking of the wooden crates or cartons containing the produce on pallets.

Pallets are generally parallelepiped in shape and of a standardized size, and have a wooden support base. A whole assembly including the base and a predetermined number of crates stacked on them is normally referred to by the term pallet.

Once the cartons or crates have been stacked on the pallet bases, a way has to be found to render the whole stable. This is usually done through a strapping operation, consisting in winding a stiff strap around the pallet using a strapping machine for a predetermined number of circuits at various heights.

The alignment of the crates on the bases is never perfect, however, and edges may project from the hypothetical and ideal surface, leading to imperfections in the tightness of the strapping which, during transport of the produce, might cause loss of pallet stability.

To obviate this occurrence, during the strapping operation right-angled members, known as angle bars, are applied to the pallets and the strapping is performed around these.

The above is normally a manual task and requires the presence of at least one person to position the angle members with an elastic band or sticky tape, while the strapping machine performs a sufficient number of circuits to hold the angle members in position.

Obviously, this is a lengthy task and is wasteful of operator time.

The principal aim of the present invention is to obviate the above-mentioned drawbacks. The invention, as characterized in the claims that follow, solves the problem by automatizing the angle member application.

SUMMARY OF THE INVENTION

The problem is solved thanks to an apparatus, which works in conjunction with a traditional strapping machine, comprising angle member magazines, constrained to a fixed part of a strapping machine, and means for moving the angle members, constrained to a mobile part of the strapping machine, which means transport the angle members from the magazines to an application point on corners of a pallet and containers stacked thereon. One of the advantages obtained through the present invention consists in the fact that no personnel is needed for the operation, leading to a saving in time and expense.

Further, an improved version of the invention enables the angle members to be positioned according to the pallet dimensions, so that the corners are always within reach of the strapping machine. In this solution, pallet position error tolerance is increased and masses are reduced.

BRIEF DESCRIPTION OF THE DRAWINGS

The invention will be described in more detail hereinunder, with the help of the figures of the drawings, which illustrate a non-exclusive and non-limiting embodiment, and in which.

DESCRIPTION OF THE PREFERRED EMBODIMENTS

Figure 1:
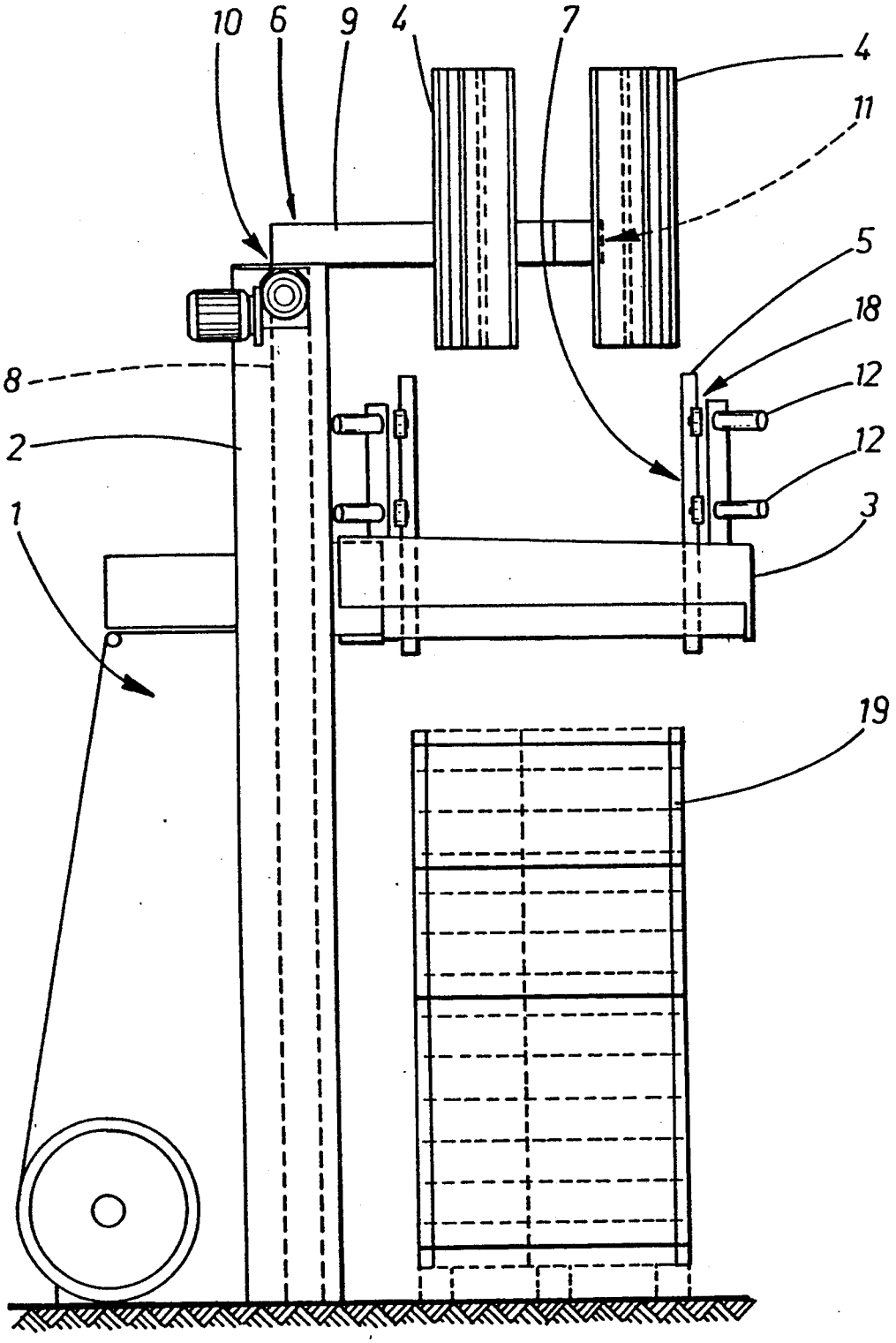
FIG. 1 is a lateral view of the invention during an operative phase.

With reference to the figures, the invention relates to an apparatus for applying angle members to pallets, associable to a traditional strapping machine 1 with a fixed vertical support 2 and a mobile horizontal support 3. The apparatus 18 for applying the angle members 5 comprises magazines 4 for storing the angle members 5 and means 7 for moving the angle members 5 from the magazines 4 to the application point. The magazines 4 are generally positioned at four corners of the pallet 19 and are constrained to projecting rod a by special constraint means 6.

The contraint means 6 between the vertical support 2 and the magazines 4 can be of various type: herein they are represented by vertical sliding guides 8, given by a broken line in FIG. 1, or, alternatively a fixed projecting rod 9 solid at a first end 10 to the vertical support 2 and at another end 11 to the magazines.

Figure 3:
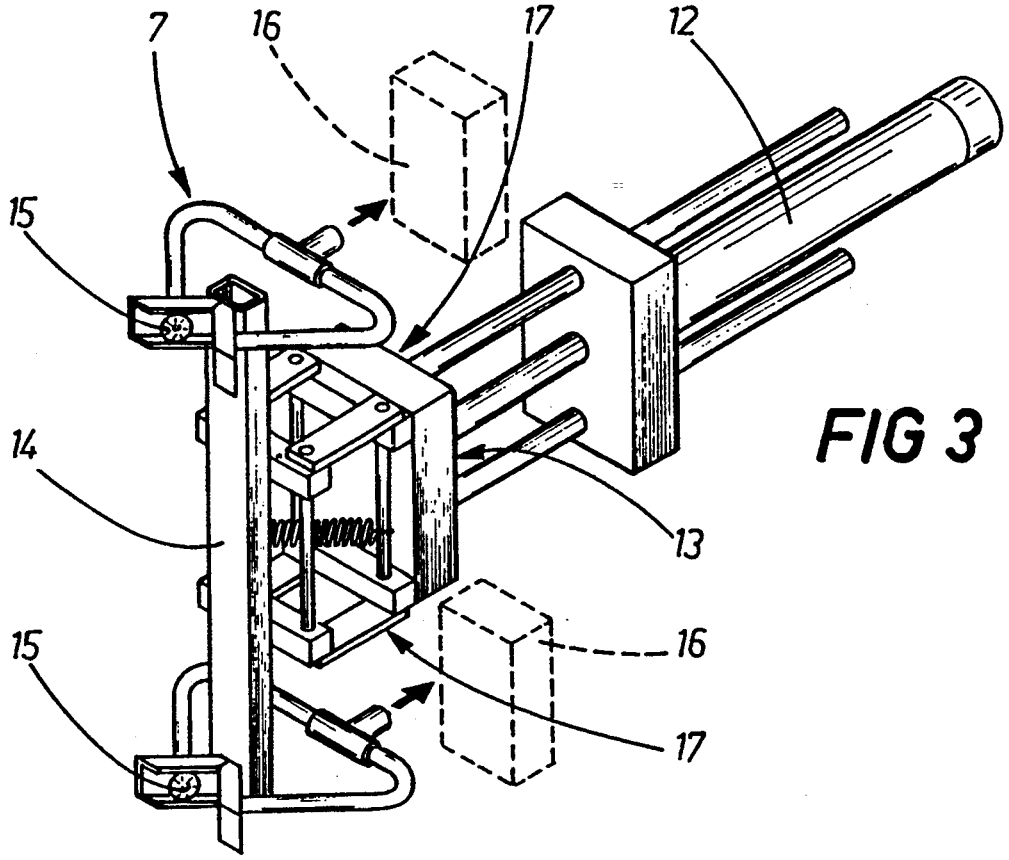
FIG. 3 shows a detail of the invention in perspective view.
Figure 2:
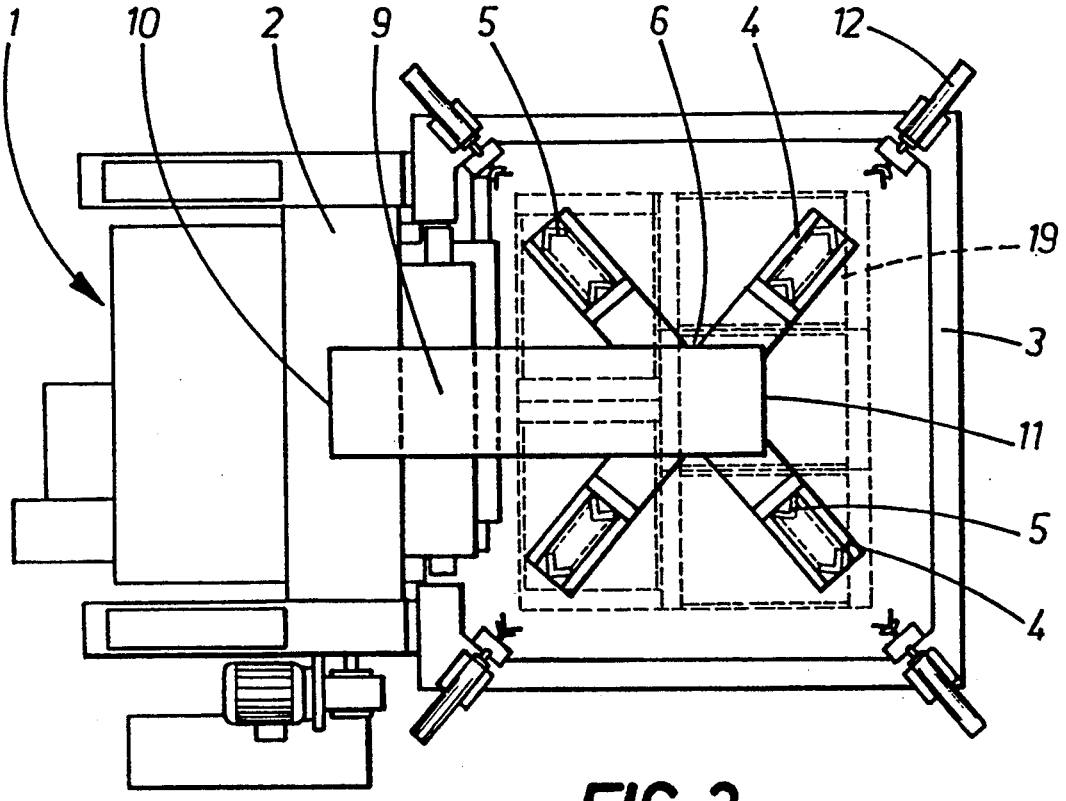
FIG. 2 shows the invention in a plan view from above.

The means 7 can also be variously conformed: for more standardized applications, which have no need for special adjustment in accordance with pallet positioning and dimensions, the type illustrated in FIG. 3 is common: each comprises at least one pneumatic cylinder 12 bearing a vertical support 14 at a free end 13, said support 14 being equipped with at least two suckers 15 connected to a vacuum generator 16, which suckers 15 grip and release angle members 5.

Also in FIG. 3, it can be seen that the free end 13 of each pneumatic cylinder 12 is constrained to a vertical support 14 by a joint of rectangular cross-section 17, so that the linear element 14 can self-center during the pallet nearing operation.

In the above embodiment, the means for moving the angle members 5 can act only in a straight line and consequently there are strict limitations on the positioning and the sizes of the pallets 19 which are to be strapped.

The only adjustable organ is the free end 13 of the pneumatic cylinders 12, which provides a significant advantage only in the immediate vicinity of the line along which the angle members 5 move.

Figure 4:
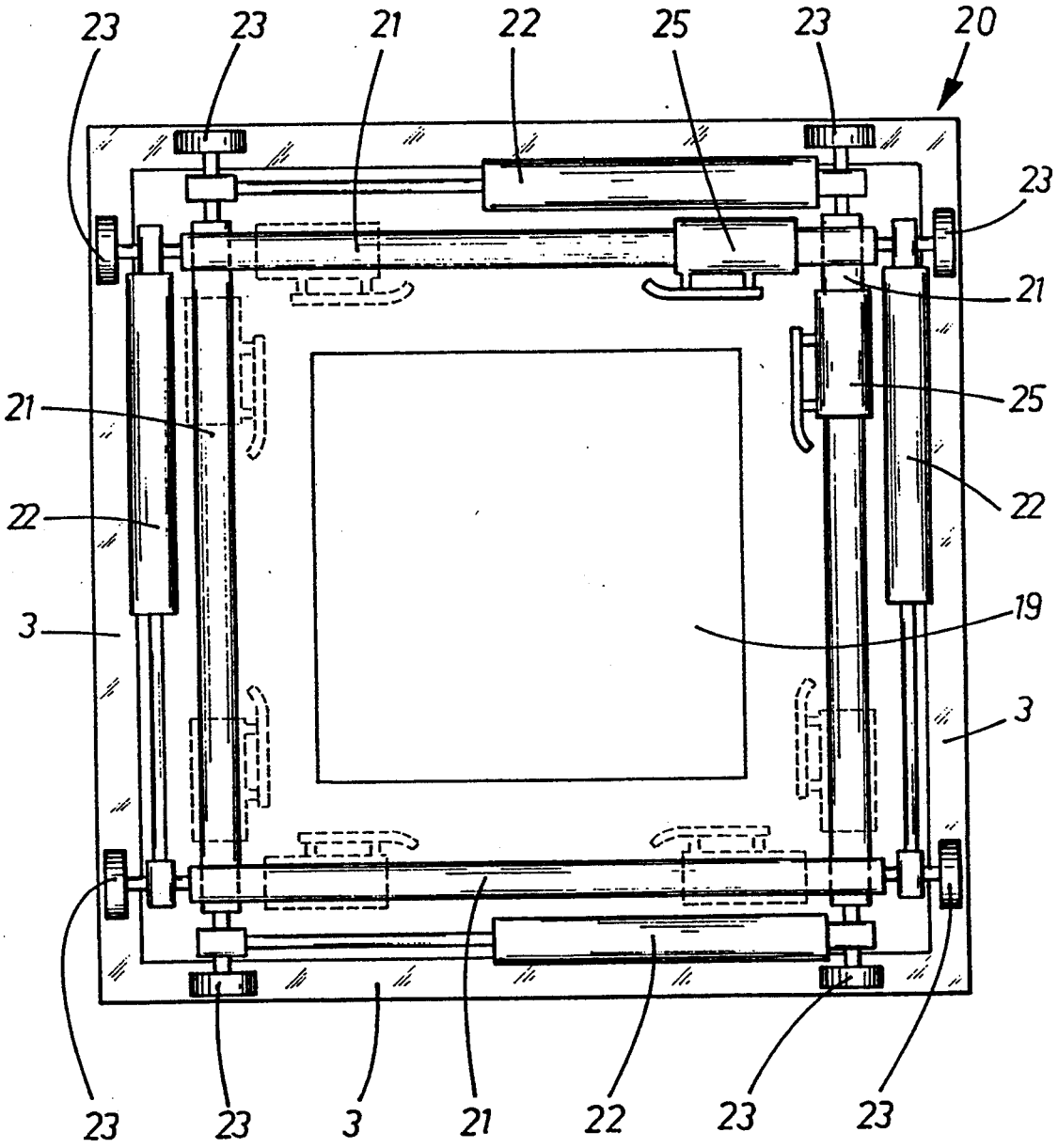
FIG. 4 shows a detail of the invention in a further embodiment, in a plan view from above.
Figure 5:
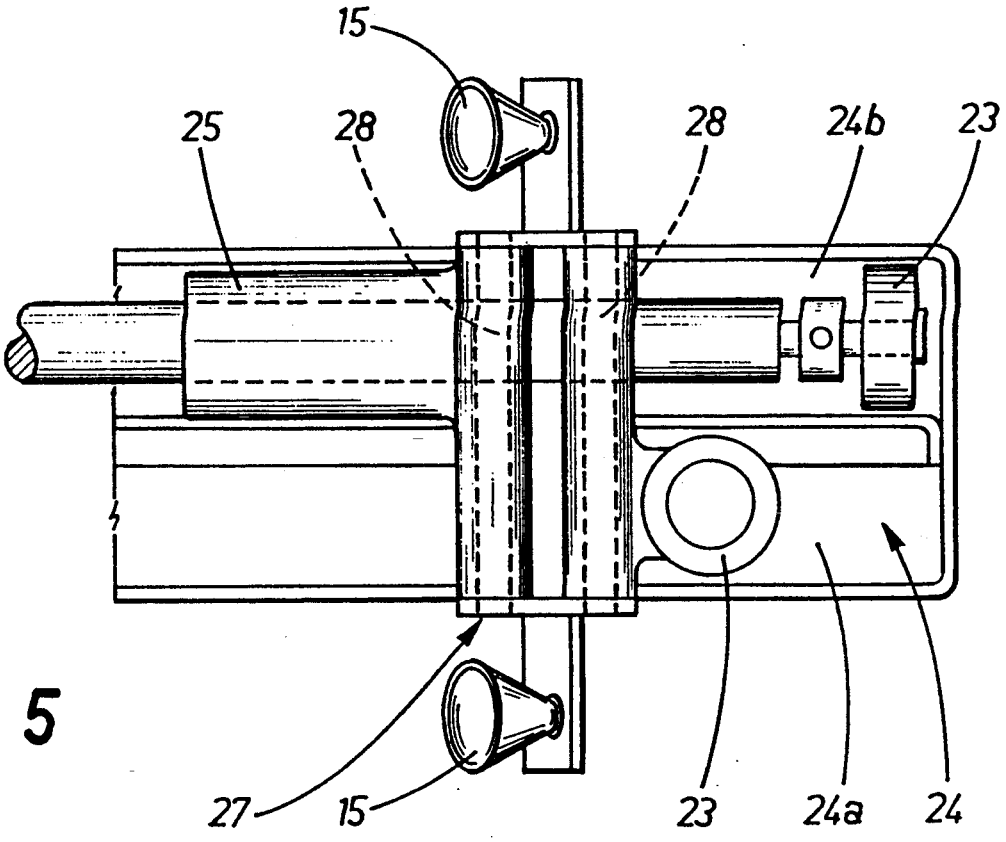
FIGS. 5 and 6 show, respectively in a lateral view and a plan view, further details of the embodiment of FIG. 4.

For this reason (see FIG. 4), it is advantageous to use movement means 7 which comprise a rectangular-plan device 20 provided with four rods 21. The opposite rods 21 are connected by pneumatic piston pairs 22 supported on idle wheels 23 which allow movement on two horizontal parallel planes, sliding in a guide 24 which is subdivided into two superposed housings **24*a*, 24*b* made on the mobile horizontal support 3**.

Two sleeves 25 are slidable on each rod 21 to deaden the impact of contact with the pallet 19. The facing ends of the sleeves 25 of two contiguous rods 21, placed at different heights, are hinged to a sucker-bearing group 27 which comprises, apart from the vertical support 14 and the suckers 15 connected to the vacuum generator 16, at least two pivots 28 which permit rotation of the sucker-bearing group 27 with respect to the sleeves 25 of the rods 21.

When the mobile horizontal support 3 reaches a predetermined height for positioning the angle members 5 removed from the magazines 4, the pneumatic pistons 22 move the rods 21 towards the pallet 19 until the skates 26 contact the pallet 19.

Figure 6:
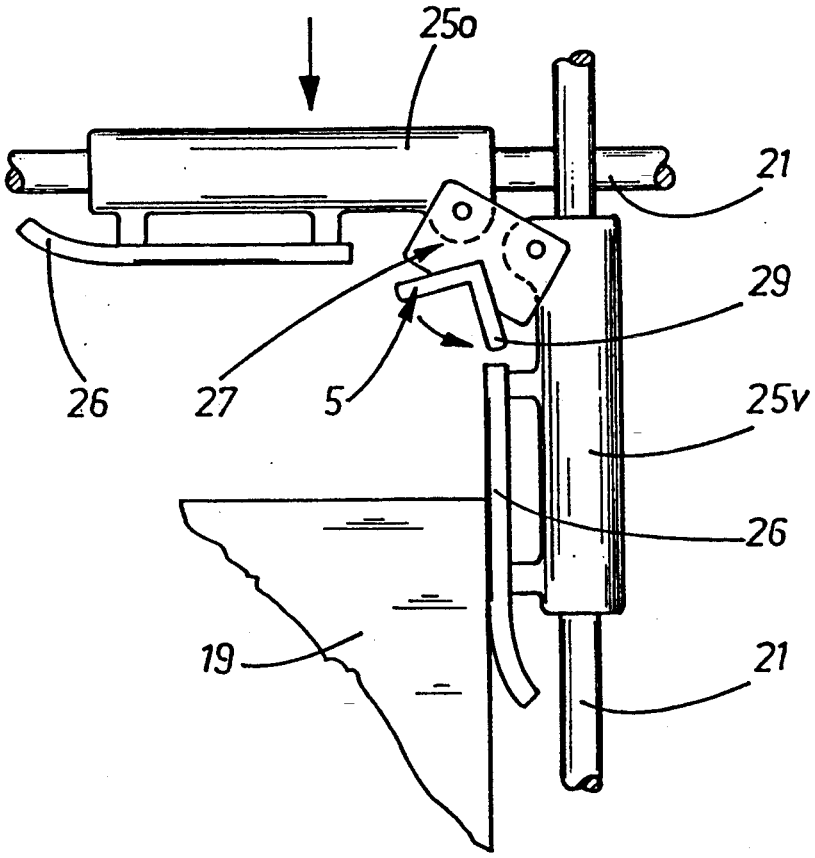

FIG. 6 shows the positioning of an angle member 5. The rod 21, here shown in a vertical position, has reached the end of its run, since its skate 26 is already in contact with the pallet 19; in this situation, the sleeve 25*v* associated to it can only move along the axis of the rod 21 to which it is constrained, opposing a resistance due to the friction of the skate 26 against the pallet 19. This friction, together with the force deriving from the downwards movement of the sleeve 25*o*, horizontal in FIG. 6, determines a rotation of the angle member 5 which aids the reliability of the apparatus 18 (the two movements are indicated by arrows), since the end 29 of the angle member 5 is moved externalwise of the pallet 19, which otherwise might hinder the correct positioning of the angle member 5.

Finally, the pallets 19 are often of such a height that one angle member 5 for each lateral edge cannot stay straight except after several strapping circuits, since the angle members are not made of metal or other specially rigid material, but usually of pressed cardboard. It is therefore advisable that the same operation is newly performed when the strapping machine 1 is at about half the height of the pallet 19, taking care that the upper angle member 5 slightly superposes the lower one, on all four edges. Apart from obtaining greater stiffness this way, lower quality materials (costing less) can be used for the task.

What is claimed:

1. An apparatus for applying angle members to pallets supporting a stack of containers, said apparatus working in conjunction with a strapping machine having a fixed vertical support and a mobile horizontal support, comprising:

magazines for holding angle members;

means for supporting the magazines from the fixed vertical support;

means for selecting and moving the angle members from the magazines to an application point on the pallet and the stack of containers, said means for moving the angle members being supported by the mobile horizontal support in such a way as to translate vertically the selected angle members together with the horizontal support.

2. An apparatus as in claim 1, wherein the means for moving the angle members comprise a rectangular-plan device constituted by:

four rods arranged in pairs on two horizontal parallel planes;

two pairs of pneumatic pistons, each pair aimed at connecting two opposing rods from the four rods;

idle support wheels, mobile in a guide made on the mobile horizontal support;

two sliding sleeves on each of said four rods;

a plurality of sucker-bearing groups, located at a cross point of a contiguous two rods of said four rods, and hinged to facing ends of the sleeves located on the contiguous two of said four rods.

3. An apparatus as in claim 2, wherein the sleeves are provided with skates for contacting respective angle members.

4. An apparatus as in claim 2, wherein each sucker-bearing group comprises:

a vertical support for at least two suckers;

at least two vertical pivots for connecting the sucker-bearing group to the sleeves of the two contiguous rods.

5. An apparatus as in claim 2, wherein the guide is provided with two superposed housings.

6. An apparatus as in claim 1, wherein the means for moving the angle members comprise for each angle member at least one pneumatic cylinder bearing at a free end, a vertical support provided with at least two suckers connected to a vacuum generator, which at least two suckers determine a gripping and a releasing of the angle members.

7. An apparatus as in claim 6, wherein the free end of each pneumatic cylinder is constrained to a vertical support by a joint of a rectangular cross-section, so as automatically to center the vertical support against the containers stacked on said pallet.

8. An apparatus as in claim 1, wherein the means for selecting and moving the angle members is capable of applying another set of angle members over a first set of positioned angle members in a partially-overlapping fashion to each corner of the pallet and containers to increase a final rigidity of the pallet and the stacked containers.

9. An apparatus as in claim 1, wherein the means for supporting said magazines from the fixed horizontal support comprise a fixed projecting rod solid at a first end to the fixed vertical support and at another end to the magazines.

10. An apparatus as in claim 9, wherein the means for supporting said magazines from said vertical support is constituted by vertical sliding guides.

* * * * *